US005336285A

United States Patent [19]

Grandek et al.

[11] Patent Number: 5,336,285

[45] Date of Patent: Aug. 9, 1994

[54] TEXTILE MACHINE HAVING A SUCTION DEVICE WITH A SEPARATOR CHAMBER

[75] Inventors: Manfred Grandek, Erkelenz; Ferdinand Szücs, Willich, both of Fed. Rep. of Germany

[73] Assignee: W. Schlafhorst AG & Co., Monchen-Gladbach, Fed. Rep. of Germany

[21] Appl. No.: 117,608

[22] Filed: Sep. 7, 1993

[30] Foreign Application Priority Data

Sep. 4, 1992 [DE] Fed. Rep. of Germany ..... 4229552

[51] Int. Cl.[5] ..... B01D 46/00

[52] U.S. Cl. ..... 55/324; 55/337; 55/343; 55/472; 55/484; 55/525

[58] Field of Search ..... 55/320, 321, 323, 324, 55/337, 343, 484, 472, 525, 345

[56] References Cited

U.S. PATENT DOCUMENTS 4,199,333 4/1980 Lerri et al. ..... 55/337 X

FOREIGN PATENT DOCUMENTS 1014003 8/1957 Fed. Rep. of Germany .
2638061 3/1977 Fed. Rep. of Germany .
2643654 4/1977 Fed. Rep. of Germany .
2905798 9/1979 Fed. Rep. of Germany .
3429024 2/1986 Fed. Rep. of Germany .
3612103 10/1986 Fed. Rep. of Germany .
3900543 7/1990 Fed. Rep. of Germany .

*Primary Examiner*—Charles Hart
*Attorney, Agent, or Firm*—Herbert L. Lerner; Laurence A. Greenberg

[57] ABSTRACT

A textile machine suction device for dust and other pneumatically conveyable waste includes a separator chamber, a negative pressure line discharging waste into the separator chamber, a first filter screen in the separator chamber for separating the waste from an air stream and for collecting the waste, a second filter screen disposed in the separator chamber, and a negative pressure source acting upon the first and the second filter screens. The two filter screens are disposed adjacent one another in a constellation causing an increasing outflow of air through the second filter screen with increasing soiling and impermeability of the first filter screen to the air stream. The negative pressure line forms a rotating air stream in the separator chamber approximately parallel to the first filter screen for forcing the waste and in particular yarn waste into a motion stripping soiling from the first filter screen.

8 Claims, 3 Drawing Sheets

TEXTILE MACHINE HAVING A SUCTION DEVICE WITH A SEPARATOR CHAMBER

BACKGROUND OF THE INVENTION

1. Field of the Invention

The invention relates to a textile machine having a suction device for dust and other pneumatically conveyable waste, with a separator chamber into which a negative pressure line discharges for the dust and waste, a filter screen for separating and collecting the waste from an air stream in the separator chamber, and a negative pressure source acting upon the filter screen.

Waste in the form of dust and yarn waste is produced in textile machines on which yarn is produced or processed. With the aid of suction devices, dust and yarn waste is already removed by suction from the textile machines at the location where it is produced. The suction devices as a rule include a fan as a negative pressure source, from which a negative pressure line extends through the machine and to which the individual suction stations are connected. As a rule, a separator chamber is disposed in front of the fan, and the dust and other pneumatically conveyable waste is separated in it by means of a filter screen. However, after a certain period of time, the filter screen becomes plugged, and the suction power of the suction device drops off sharply, even though the separator chamber is not completely full. The reason for this is the unfavorable distribution of the waste separated out in front of the filter screen. Due to an overly great accumulation of dust and yarn waste in the suction region of the fan, its suction power is lessened.

This drop in suction power results in increased vulnerability of the textile machines to trouble in yarn production or yarn processing.

Separator chambers already exist in which a striplike filter medium moves through the separator chamber in front of the fan that produces the suction and removes the accumulated dust and other waste. One such apparatus is known from German Published, Non-Prosecuted Application DE 39 00 543 A1, for instance. However, separator chambers equipped in that way are expensive to manufacture and require more space. That is why the disadvantage of frequent manual cleaning of the separator chamber is generally tolerated, even though the separator chambers are not yet filled beyond a degree which is far below the limit of their capacity.

SUMMARY OF THE INVENTION

It is accordingly an object of the invention to provide a textile machine having a suction device with a separator chamber, which overcomes the hereinafore-mentioned disadvantages of the heretofore-known devices of this general type and which provides a separator chamber in such a way that its capacity is optimally utilized, without the suction power of the suction device dropping as the degree of filling rises.

With the foregoing and other objects in view there is provided, in accordance with the invention, in a textile machine, a suction device for dust and other pneumatically conveyable waste, comprising a separator chamber; a negative pressure line discharging waste into the separator chamber; a first filter screen in the separator chamber for separating the waste from an air stream and for collecting the waste; a second filter screen disposed in the separator chamber; and a negative pressure source acting upon the first and the second filter screens; the two filter screens being disposed adjacent one another in a constellation or configuration causing an increasing outflow of air through the second filter screen with increasing soiling and impermeability of the first filter screen to the air stream; and the negative pressure line forming a rotating air stream in the separator chamber approximately parallel to the first filter screen for forcing the waste and in particular yarn waste into a motion stripping soiling from the first filter screen.

By placing the second or further filter screen in an adjacent wall of the separator chamber and acting upon this filter screen with the same negative pressure source, the flow conditions are substantially improved over a conventional separator chamber with an inlet opening for the negative pressure line, an opening for connecting the negative pressure source, and a filter screen disposed in front of it. When the filter screens in the separator chamber are still completely clean, the air initially takes the direct path from the inlet opening of the negative pressure line to the negative pressure source. With increasing trapping of dust on the filter screen in front of the negative pressure source, the flow conditions within the separator chamber change in such a way that eddies in the air arise within the chamber. These eddies impart rotary motions to the yarn waste inside the separator chamber, especially parallel to the filter screen that is disposed in front of the negative pressure source, in front of the fan that generates the suction. As a result, the development of a permanent, firmly adhering deposit of waste on the filter screen in front of the negative pressure source is avoided to the maximum extent. In an eddy in the air, yarn waste and dust are increased by the longer dwell time in a floating state, and they mat together. Yarn waste that is then too heavy for transport in the flowing air drops to the bottom of the separator chamber. This promotes an even deposit of dust and waste inside the separator chamber. In particular, deposits that are already located on the filter screen are removed by the yarn waste that is set into rotation. The degree of filling with waste in the separator chamber of the invention is increased substantially by the invention, as compared with a conventional separator chamber. Even with virtually complete utilization of the degree of filling of the separator chamber, no notable drop in suction power of the suction device can be found.

Due to the association of the two filter screens with two adjacent chamber walls and their disposition with each being spaced apart from the respective wall, it is simple for the part of the separator chamber partitioned off by the additional filter screen to be connected to the negative pressure source. Therefore, in accordance with another feature of the invention, the filter screens are each spaced apart from and disposed in front of the walls, and the filter surface area is then approximately equivalent to the wall surface area.

In accordance with a further feature of the invention, in order to generate the eddy current, it is advantageous if the separator chamber has a prismatic form and if the additional filter screen is smaller than the filter area of the filter screen in front of the negative pressure source. The prismatic shape makes it possible to place the additional filter screen in front of one of the end surfaces of the separator chamber.

In accordance with an added feature of the invention, the separation action is substantially increased if the additional filter screen occupies approximately the area of the separator chamber in front of which it is disposed.

In accordance with an additional feature of the invention, an optimal degree of filling of the separator chamber of the invention is attained by providing that the negative pressure line discharges from above through a ceiling into the separator chamber, and that the filter screens are disposed in front of two side walls. The original filter screen, with the negative pressure source disposed behind it, is then disposed along one of the broad sides, and the additional filter screen is disposed along one of the end surfaces. Like the original filter screen, it is placed at a distance from and in front of the wall of the separator chamber, and the part of the chamber partitioned off by the filter screen communicates diagonally with the space of the separator chamber located in front of the negative pressure source. Thus the air is first aspirated from the parts of the separator chamber partitioned off by the filter screens, causing an air flow through the filter screens. An opening for cleaning the filter chamber may be provided in one of the walls that are not covered by the filter screens.

Other features which are considered as characteristic for the invention are set forth in the appended claims.

Although the invention is illustrated and described herein as embodied in a textile machine having a suction device with a separator chamber, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The invention will be described in terms of an exemplary embodiment in a bobbin winder machine. However, the separator chamber according to the invention may be used wherever dust and other pneumatically conveyable waste is removed by means of a suction device and the waste from the air stream is separated in a separator chamber and collected.

Figure 1:
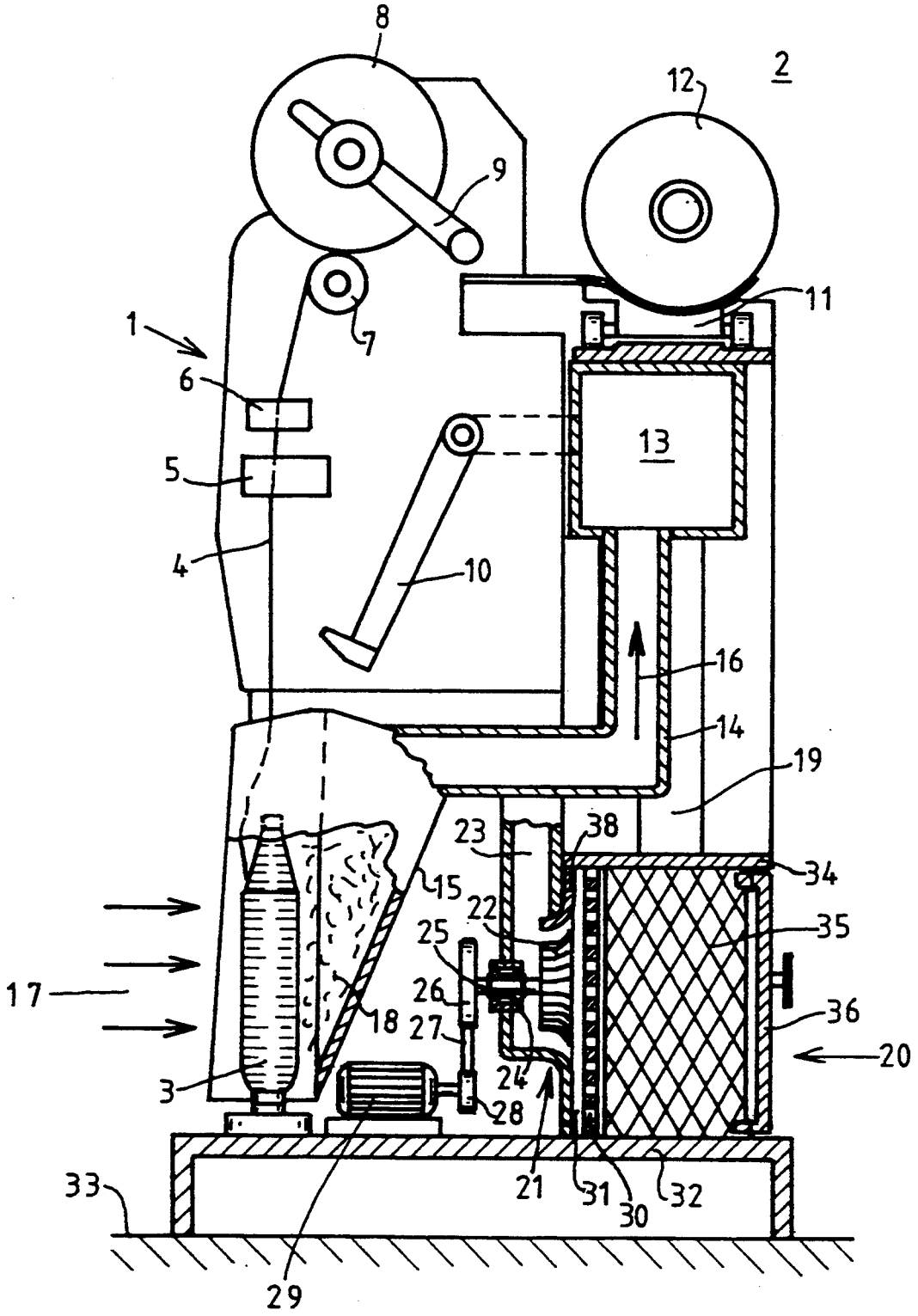
FIG. 1 is a diagrammatic, partly broken-away, longitudinal-sectional view of a bobbin winder machine, as an example of a textile machine having a separator chamber according to the invention.

Referring now to the figures of the drawing in detail and first, particularly, to FIG. 1 thereof, there is seen a section of one winding station of a bobbin winder having a number of winding stations. Devices required for spooling up the yarn are known from the prior art and are therefore not shown in detail nor explained herein.

In FIG. 1, a winding station 1 of a bobbin winder, that is identified overall by reference numeral 2, is shown diagrammatically. A spinning bobbin 3, which is a cop, is in an unwinding position in the winding station 1. A yarn 4 drawn off from the spinning bobbin 3 passes through a yarn joining device 5 which is a splicer, and a yarn quality monitor 6 which is a so-called cleaner, and then is deposited by a yarn guide drum 7 in crosswise layers on a takeup bobbin 8 which is a cross-wound bobbin or cheese.

The cheese 8 rests on the yarn guide drum 7, with which it is driven. The cheese 8 is held by a bobbin holder 9. A suction nozzle 10 which is also shown, removes torn yarns from the takeup bobbin 8 and places them in the yarn joining device 5. A transport device 11, on which the fully wound delivery bobbins 12 can be carried away, is suggested in the drawing at the back of the winding station 1. A negative pressure conduit 13 can be seen in section below the transport device 11. The conduit 13 supplies the winding stations of the bobbin winder with the suction required for operation, for instance for the removal of waste yarns by suction or for looking for yarn ends on the delivery bobbin 8 with the aid of the suction nozzle 10 in order to place them in the yarn joining device 5.

One suction tube 14 branches off from the negative pressure conduit 13 at each bobbin. At the point where the spinning bobbin 3 is unwound, the spinning bobbin 3 is surrounded by a boxlike connector 15. The negative pressure, which is symbolized by an arrow 16 and prevails in the suction tube 14, creates an air flow, as is represented by arrows 17, through which dust 18 occurring as the yarn 4 arrives at the spinning bobbin 3 is removed by suction. The dust 18, together with the yarn waste aspirated by the suction nozzle 10, is sucked into the negative pressure conduit 13. The negative pressure conduit 13 extends along the entire machine. The dust and the yarn waste from all of the winding stations connected to the negative pressure conduit 13, are transported at the end of the machine through a negative pressure line which is a tube 19, into a separator chamber 20. The requisite negative pressure at the bobbin winder is generated by a fan 21, having an impeller wheel 22 which is disposed in a left side wall 38 of the separator chamber 20. The impeller wheel 22 is surrounded by a waste air shaft 23, through which waste air is removed to the top of the machine, although that is not shown herein. A bearing 24 of an impeller wheel shaft 25 is inserted into a wall of the waste air shaft 23. A pulley 26 is disposed on the shaft 25, and a belt 27 travels by way of the pulley 26 to a pulley 28 of a drive motor 29 for driving the impeller wheel 22.

The separator chamber 20 is shown in a sectional view taken at the level of the impeller wheel 22 of the fan 21. Inside the separator chamber, a first filter screen 30 is disposed in front of and spaced apart from the impeller wheel 22 of the fan. A spacing 31 from the side wall 38 amounts to a few centimeters. If the present separator chamber 20 has dimensions of approximately 800 mm in width, 700 mm in height and 300 mm in depth, this spacing 31 is approximately 50 mm. The filter screen 30 extends from a bottom 32 of the separator chamber 20, which at the same time forms a machine frame and stands on a base 33, to a ceiling 34 of the separator chamber. In the present exemplary embodiment, the filter screens is formed of a wire mesh with a very small mesh or opening width.

An additional or second filter screen 35 of the invention is disposed in front of the end wall at right angles to the filter screen 30. The filter screen 35 likewise extends from the bottom 32 to the ceiling 34 of the separator chamber 20. The separator chamber 20 is closed at the back of the machine by a door 36, which can be opened for cleaning purposes.

Figure 2:
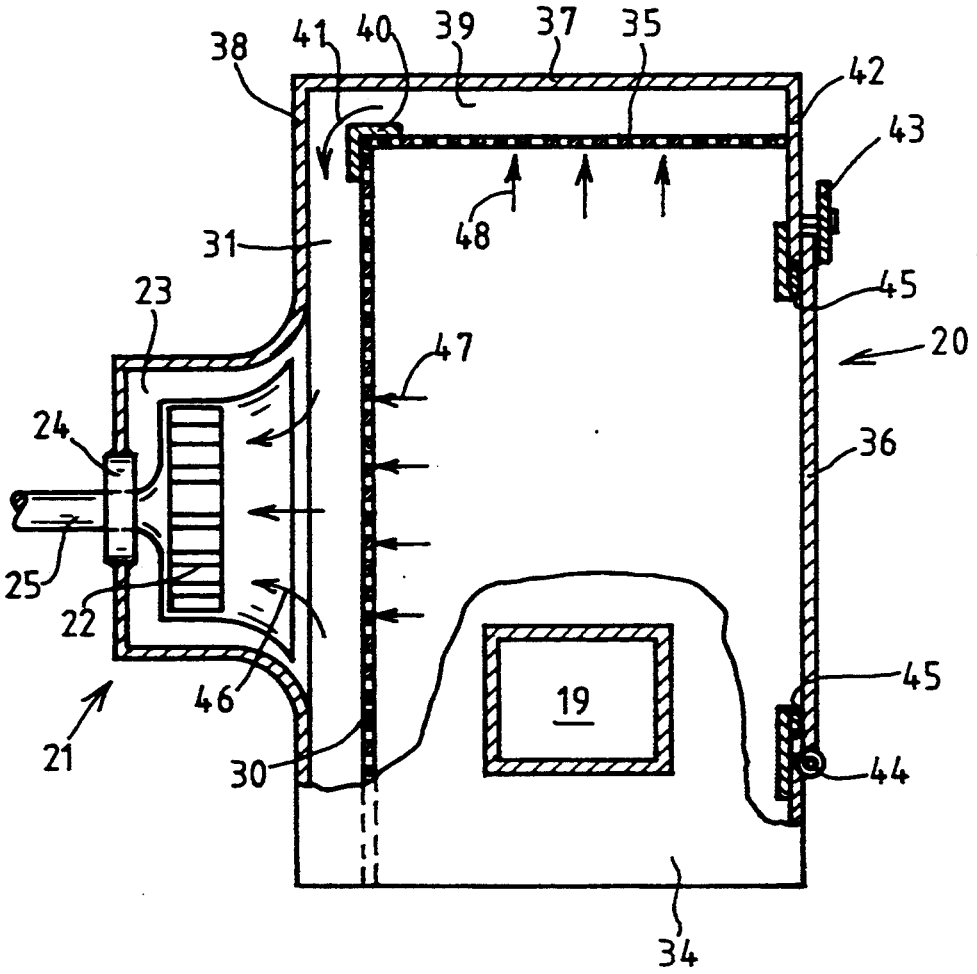
FIG. 2 is an enlarged, fragmentary, partly broken-away, plan plan view of the separator chamber with an additional filter screen.

In FIG. 2, the separator chamber 20 is shown on a larger scale than in FIG. 1. FIG. 2 shows a plan view of the separator chamber, in a section taken at the level of the impeller wheel 22 of the fan 21. It can be seen from FIG. 2 in combination with FIG. 1 that the separator chamber 20 has a prismatic shape. The additional filter screen 35 is disposed in front of one end surface or wall 37 of the separator chamber. The fan 21 is located in the side wall 38 at right angles to that end surface. Like the filter screen 30, the filter screen 35 is also spaced apart, by a distance 39, from the end surface 37. The distance 39 of the filter screen 35 from the end surface 37 is approximately equal to the spacing 31 of the filter screen 30 from the side wall 38. The two filter screens 30 and 35 meet at a stanchion 40 and are held by it in such a way that the distance 39 partitioned off by the filter screen 35 communicates with the negative pressure source which is the fan 21, through the space 31 that is partitioned off by the filter screen 30 from the side wall 38. This is indicated by arrows 41.

Figure 3:
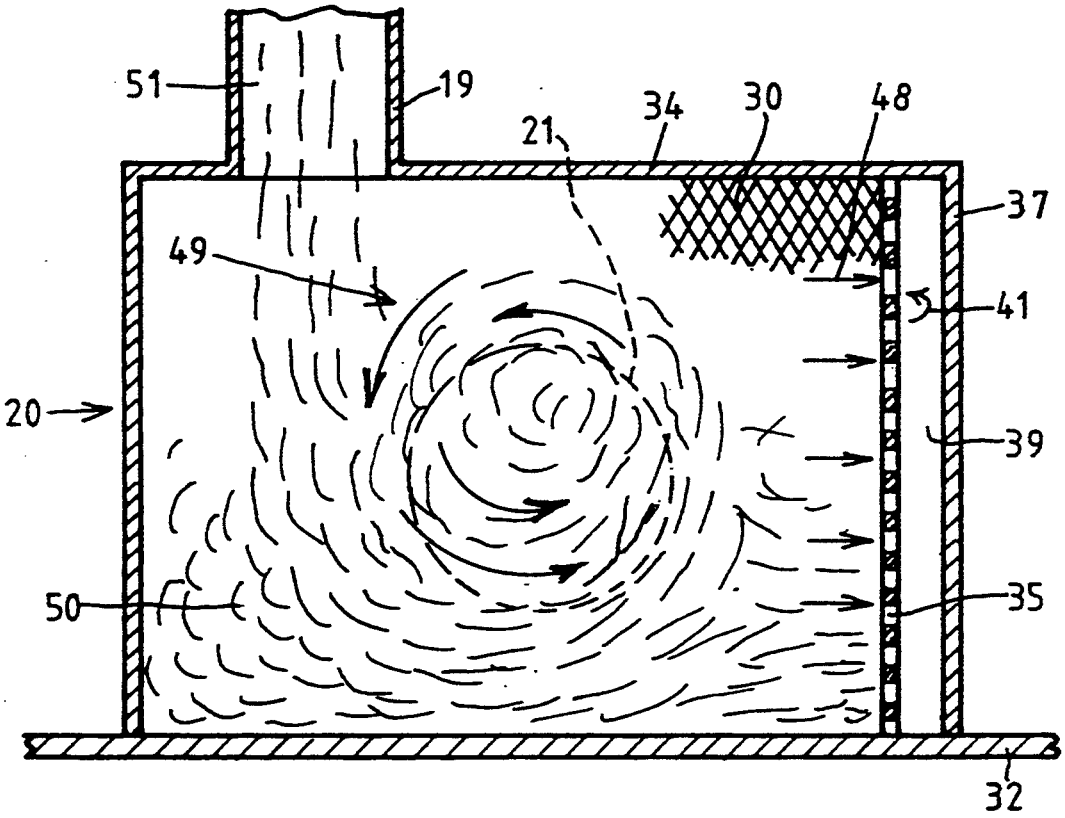
FIG. 3 is an enlarged, fragmentary, longitudinal-sectional view of the separator chamber showing flow conditions therein.

The negative pressure line 19 discharges vertically from above through the ceiling 34 into the separator chamber 20. An air stream 51 laden with waste and dust 50 is introduced through the line 19, as is seen in FIG. 3. In order to enable the configuration of the filter screens to be shown, the ceiling 34 is only partly shown in FIG. 2. The door 36 closes an opening in the side wall 42 opposite the fan 21. A lock 43 which is shown in suggested fashion is intended to indicate that the door 36 can be opened swivelably about a hinge 44 for cleaning of the separator chamber 20. The door 36 can be closed in airtight fashion by means of sealing strips 45.

If the fan 21 is in operation and the impeller wheel 22 is producing suction 46, the air flows through not only the filter screen 30, as is indicated by arrows 47, but also through the filter screen 35, as is indicated by arrows 48. The air removed by suction across the filter screen 35 tends to flow across the space 31 partitioned off by the filter screen 30 to the fan 21, as is indicated by the arrow 41.

Depending on the degree to which the separator chamber 20 is filled, the flow conditions through the two filter screens 30 and 35 will vary. Initially, the air flow will take the direct path, as is indicated by the arrows 47, so that in the region of the fan 21 the filter screen 30 will plug up with dust before the filter screen 35 does. This causes the flow conditions inside the separator chamber to change. A rotating air flow 49 is created, as is shown in FIG. 3, particularly in the region of the fan 21. The flow 49 extends approximately parallel to the first filter screen 30. This produces a rotational motion of the separated yarn waste 50. That causes a certain wiping action on the dust deposits and yarn waste deposits on the filter screen surface in front of the fan. As a result, direct plugging of the filter screen 30 is avoided. Filling of the separator chamber 20 with the yarn waste and dust, which is brought from above through the negative pressure line 19, takes place more uniformly than in a conventional separator chamber, so that a loss in the prevailing negative pressure can nevertheless be averted, up to a high degree of filling of the separator chamber. Placing a second filter screen at right angles to the existing filter screen, in accordance with the invention, makes for more effective utilization of the separator chamber, averts trouble in the bobbin winder by avoiding a sudden drop in the negative pressure, and markedly lengthens the time intervals before the separator chamber has to be emptied.

We claim:

1. In a textile machine, a suction device for dust and other pneumatically conveyable waste, comprising:
   - a separator chamber;
   - a negative pressure line discharging waste into said separator chamber;
   - a first filter screen in said separator chamber for separating the waste from an air stream and for collecting the waste;
   - a second filter screen disposed in said separator chamber; and
   - a negative pressure source acting upon said first and said second filter screens;
   - said two filter screens being disposed adjacent one another in a configuration causing an increasing outflow of air through said second filter screen with increasing soiling and impermeability of said first filter screen to the air stream; and
   - said negative pressure line forming a rotating air stream in said separator chamber approximately parallel to said first filter screen for forcing the waste and in particular yarn waste into a motion stripping soiling from said first filter screen.

2. The textile machine suction device according to claim 1, wherein said separator chamber has walls, said first filter screen is disposed in said separator chamber in front of one of said walls, and said second filter screen is disposed in said separator chamber at a distance in front of another of said walls.

3. The textile machine suction device according to claim 1, wherein said separator chamber has walls, and said negative pressure source has an inlet neck disposed in one of said walls.

4. The textile machine suction device according to claim 2, wherein said negative pressure source has an inlet neck disposed in one of said walls.

5. The textile machine suction device according to claim 1, wherein said first filter screen is disposed in front of said negative pressure source and has a given surface area, and said second filter screen has a surface area being smaller than said given surface area.

6. The textile machine suction device according to claim 1, wherein said separator chamber has a prismatic shape with a ceiling and two mutually perpendicular side walls being adjacent said ceiling, said negative pressure line transports and discharges dust and other pneumatically conveyable waste from above through said ceiling into said separator chamber, and said filter screens are disposed in front of said two side walls.

7. The textile machine suction device according to claim 5, wherein said separator chamber has end surfaces, and said second filter screen is disposed in front of one of said end surfaces.

8. The textile machine suction device according to claim 1, wherein said separator chamber has walls, each of said filter screens is disposed at a distance in front of a respective one of said walls defining intermediate chambers between said walls and said filter screens, and each of said filter screens has essentially the same dimensions as said wall in front of which it is disposed, minus a surface area in said intermediate chamber between the other of said filter screens and said wall in front of which it is disposed.

* * * * *